United States Patent [19]

Weinich et al.

[11] Patent Number: 4,907,375

[45] Date of Patent: Mar. 13, 1990

[54] GRINDING WHEEL

[75] Inventors: Gunter Weinich, Lorch; Herbert Setzer, Stuttgart, both of Fed. Rep. of Germany

[73] Assignee: Fortuna Werke Maschinenfabrik GmbH, Fed. Rep. of Germany

[21] Appl. No.: 288,015

[22] Filed: Dec. 20, 1988

[30] Foreign Application Priority Data

Dec. 23, 1987 [DE] Fed. Rep. of Germany ..... 3743810
Jul. 12, 1988 [DE] Fed. Rep. of Germany ..... 3823591

[51] Int. Cl.[4] ..... B24B 41/04
[52] U.S. Cl. ..... 51/168
[58] Field of Search ..... 51/168; 83/666, 676, 83/698; 403/350, 383; 409/231, 232, 234

[56] References Cited

U.S. PATENT DOCUMENTS 4,577,440 3/1986 Junker ..... 51/168

FOREIGN PATENT DOCUMENTS 3322258 6/1983 Fed. Rep. of Germany .

*Primary Examiner*—Roscoe V. Parker
*Attorney, Agent, or Firm*—Walter A. Hackler

[57] ABSTRACT

A grinding wheel comprises a disk-shaped body (12) which is equipped with a peripheral processing surface consisting of a grinding material. There is further provided an at least two-part flange (20, 21) retaining the body (12) on both sides thereof and provided with a mounting opening (22) for a holding arbor of a grinding machine. In order to achieve a centering effect between the body and the flange, with the simplest possible constructional means, a first flange part (20) is provided with a circumferential surface (34) whose cross-section, taken along a radial plane, exhibits the shape of an n-cornered polygon. The body (12) is in contact with the circumferential surface (34) via bolts (32) projecting radially inwardly. The number of bolts (32) corresponds to the number of the corners of the polygon. The bolts (32) can be rotated relative to the circumferential surface (34) in the circumferential direction.

15 Claims, 6 Drawing Sheets

GRINDING WHEEL

The present invention relates to a grinding wheel comprising a disk-shaped body equipped with a peripheral processing surface consisting of a grinding material, and a flange, preferably of a two-part design, retaining the body preferably by its two sides and provided with a mounting opening for a holding arbor of a grinding machine.

Grinding wheels of the type described above have been known before.

In the case of known grinding wheels, the whole body consists of grinding material, and the circumference of the body is provided with an outer cylindrical or outer conical grinding surface, depending on whether the axis of the grinding spindle extends in parallel or at an angle to the axis of the workpiece to be worked.

In order to provide this body, which consists integrally of a grinding material, with holding means that can be mounted on the metallic holding arbor of the grinding spindle, multi-part flanges are used in the case of the known grinding wheels. These flanges embrace the body by its two flat sides over large contact areas, and are passed on the other hand through a big central opening in the body so as to form therein a metallic mounting opening for the holding arbor of the grinding spindle.

It is a problem of these known grinding wheels that the multi-piece mounting flange must be centered relative to the body of the grinding wheel. When the body of the grinding wheel consists of grinding material throughout, a certain eccentricity between the body and the flange may be taken into account because after mounting of the flange the body can be dressed to restore its rotational-symmetrical shape.

However, this procedure results in a certain loss of grinding material so that it cannot be applied when the grinding wheel consists of a metallic carrier body and when only its circumference is provided with a high-quality grinding material, such as CBN (Cubic Boron Nitride). Arrangements of this type have been known, for example, from DE-PS33 22 258.

In the case of this known grinding wheel, a disk-shaped metallic body of a grinding wheel is provided with a cylindrical mounting opening comprising three axially parallel grooves distributed evenly over its circumference. In contrast, the mounting arbor of the respective grinding machine has a cylindrical design, the diameter of the cylinder being substantially smaller than the diameter of the mounting opening of the body of the grinding wheel. The holding arbor is provided with three axially extending, parallel wedges distributed evenly over its circumference. The wedges exhibit a circular cylindrical circumferential surface, the diameter of this circular cylindrical end face of the wedges being only 10 $\mu$m smaller than the inner diameter of the circular cylindrical mounting opening in the body of the grinding wheel. The edges of the circular cylindrical portions of the wedges are provided with oblique surfaces inclined in the circumferential direction. For mounting the known grinding wheel, the latter is pushed axially upon the arbor in a circumferential position in which the wedges engage exactly the grooves, the arrangement being such that the wedges extend over a smaller circumferential angle than the grooves. In this condition, the grinding wheel is seated on the arbor with sufficient play. Now, when the grinding wheel is rotated relative to the holding arbor, the circular cylindrical portions of the mounting opening in the body of the grinding wheel on the one hand and the prongs of the holding arbor on the other hand come to overlap each other with the result that the grinding wheel is now positioned on the holding arbor with only little radial play, in the range of a few $\mu$. Finally, a fixing flange is fitted on the outer end of the holding arbor and screwed to the grinding wheel and a supporting part of the holding arbor.

The described known arrangement is connected with the disadvantage that the fit between the grinding wheel and the holding arbor can never be better than the difference in diameter between the described circular cylindrical portions. In addition, it is a drawback of the known grinding wheel that there is no defined circumferential position in which optimum centering is obtained between the grinding wheel and the holding arbor because in the overlapping condition of the described circular cylindrical portion the grinding wheel can be rotated relative to the holding arbor by a circumferential angle of approx. 45° , without any change regarding the fit between the holding arbor and the grinding wheel. However, this is a disadvantage for the mounting operation because the holding arbor, which can rotate freely within the described angular range, must be held in place while the fixing flange is positioned on the holding arbor, whereafter a total of three bores in the fixing flange, the grinding wheel and the supporting part must be aligned relative to each other in order to enable the different elements to be screwed together.

Now, it is the object of the present invention to improve a grinding wheel of the type described above so that precise centering of the body relative to the flange is rendered possible while keeping the mounting process extremely simple.

This object is achieved according to the invention by the fact that a first flange part is provided with a circumferential surface whose cross-section, taken along a radial plane, exhibits the shape of an n-cornered polygon, that the body is in contact with the circumferential surface via elements projecting inwardly, that the number of the said elements corresponds to the number of the corners of the polygon and that the elements can be rotated relative to the circumferential surface in the circumferential direction.

The object underlying the present invention is solved in this manner fully and perfectly because the described solution makes use of the self-centering properties of polygonal connections. In addition, however, the invention offers the particular advantage that the mounting surfaces are not both designed as polygons, but that only the first flange part has to offer a polygonal outer circumferential surface, while the matching countersurface of the body may be seated on the outer circumferential surface only by the elements at a finite number of positions. When the two parts are then rotated relative to each other, a self-centering effect will occur because the elements come into contact with the polygonal surface in such a manner that the axis of the part supported on such surface must necessarily be aligned with the axis of the first flange part. From the above description, it already follows that the arrangement may of course be reversed, i.e. that the first flange part may be provided with the elements and the complementary part of the body may exhibit the polygonal circumferential surface.

This arrangement, therefore, eliminates any need for time and money-consuming centering operations or re-working of the grinding wheel, because an automatic centering effect is obtained simply by rotating the above-mentioned parts, so that the grinding wheel according to the invention can be mounted with a few manipulations by which it is automatically centered.

The grinding wheel according to the invention, therefore, makes it possible to employ bodies of the type which consist of a disc-shaped metal part and are provided with a trimming of grinding material, for example CBN grinding material, only on its outer circumference. Grinding discs of this type cannot be balanced in the usual manner in the event of an existing eccentricity as it would be impossible, in view of the considerably smaller weight of the trimming consisting of the grinding material, to compensate a physical eccentricity and, consequently, an imbalance of the metallic body by dressing the trimming.

The grinding wheel according to the invention eliminates these disadvantages by the fact the relatively heavy metallic disc-shaped body is mounted on the flange in a self-centering manner.

According to a preferred embodiment of the invention, the inner circumference of the body embraces a first ring part provided with a plurality of elements which are distributed evenly over its circumference and which are arranged in the first ring part and project inwardly thereof.

This feature provides the advantage that the part equipped with the elements is easy to produce because only one rotational-symmetrical and, accordingly, easy-to-produce first ring part has to be provided with the radially projecting elements. Further, it is possible in this manner, without great constructional difficulties, to use polygons of any desired corner number because if a triangular polygon is used, for example, corresponding first ring parts can be used which then have to be provided only with three or four elements distributed over their circumference.

According to a preferred variant of this embodiment of the invention, the elements take the form of, preferably, cylindrical bolts comprising a shoulder projecting radially from the first ring part.

This feature provides the advantage that when the bolts are arranged in the radial direction, the radial position of the projecting shoulders can be adjusted conveniently to ensure precise centering.

According to a preferred feature of this variant, the shoulder exhibits a non-circular shape and is held laterally in flange parts.

This feature provides the advantage that any rotation of the bolts in the assembled condition can be excluded. This also favors the adjustment of the ring part regarding the position of the free end of the bolts relative to the axis of symmetry of the first ring part.

According to another variant of the embodiment of the invention, the elements are in contrast designed in the form of balls which are retained, in the circumferential direction of the grinding wheel, by the ring part taking the form of a cage, and which are in contact on the one hand with the circumferential surface and on the other hand with the inner circumference.

This feature provides the advantage that during the centering action rolling friction will occur only between the machine parts to be centered relative to each other. In addition, a certain axial movement is rendered possible in the centered condition. On the other hand, the balls will roll also in the prestressed condition which enables the grinding wheel to follow the clamping force. Moreover, the grinding wheel can be disassembled without changing the centered position. Finally, the fact that the balls are in contact with two sides, i.e. with the circumferential surface on the one hand and the inner circumference on the other hand, leads to the condition that no adjustment of the balls is necessary in the radial direction. According to another preferred embodiment of the invention, two flange parts embrace the body on two sides thereof.

These feature provides the advantage that the centering elements, for example the first ring part, can be covered so that the soiling and the resulting problems during disassembly and re-assembly can be safely avoided.

According to a particularly preferred variant of this arrangement, the flange parts are interconnected by means of first axial screws, so that the body is retained in a force-locking manner, and the first screws are passed through first oblong holes provided in the first ring part and extending in the circumferential direction.

This feature provides the advantage that the body can be retained in force-locking engagement with an amply sized annular surface, by tightening the first screws, which excludes any unwanted rotation of the body between the flange parts. By providing the first oblong holes in the first ring part, the assembly and adjusting elements of the grinding wheel according to the invention can be located within a limited circumferential area of the flange parts so that sufficient space is left for the mounting opening and for the arrangement of the entraining surfaces of the flange parts on the body.

According to a further preferred improvement, the first ring part is provided with retaining means, in particular bores, enabling the first ring part to be rotated in the circumferential direction by means of a tool.

In cases where the first ring part is covered by a flange part, the latter is, preferably, provided with second oblong holes which extend in the circumferential direction and which gives access to the retaining means in the first ring part.

The features described above provide the advantage that the first ring part can be rotated in an extremely simply manner by providing a suitable tool which can be introduced into the retaining means, for example the bores, of the first ring part, through the second oblong holes, in order to rotate the first ring part, which is enclosed between the flange parts, in the circumferential direction. The tool required for this purpose may be designed, for example, in the manner of a steering wheel of the motor vehicle provided, on the side facing away from the user, a rod extending radially through the axis of symmetry of the steering wheel and carrying two or more axially projecting pins capable of engaging the bores in the first ring part, through the said second oblong holes. By rotating the steering wheel, the first ring part can then be rotated between the two flange parts in the circumferential direction so that the elements, i.e. the bolts or balls, come to bear against the polygonal circumferential surface of the first flange part and/or the inner circumference of the body.

Although, as mentioned before, polygons of any desired number of corners may be used as a cross-sectional shape of the circumferential surface of the first flange part, preference is given to an embodiment of the invention where the circumferential surface exhibits the cross-sectional shape of a polygon the number of corners of which is a multiple of three.

This feature provides the advantage that known grinding programs can be used for grinding the circumferential surface of the first flange part. Moreover, a modification of this variant is of particular advantage where the polygon is a so-called constant-diameter cam, as this term is explained in more detail and defined by DIN 32711. As is generally known, the diameter of such a constant-diameter cam is identical at all points of the polygon so that a particularly uniform distribution of the force is achieved when torques are transmitted through the polygon connection.

It is understood in this connection that the number of bolts and/or balls or of other radially projecting elements need not necessarily be equal to the number of corners of the polygon, but may correspond to the number of corners of the polygon also in such a manner that, for example, a total of three bolts or balls are provided for a six-cornered polygon, one for every second side, or a total of six bolts or balls are provided for a twelve-cornered polygon, again one for every second side.

According to another preferred embodiment of the grinding wheel according to the invention, elastic braking means acting between the flange part and the body in the axial direction, are provided on a flange part.

This feature provides the advantage that when turning the first ring part for automatic centering of the body on the first flange part, the body will not be entrained because it is fixed in position, in the circumferential position, on the respective flange part via the described braking means. At the same time, the elastic means, for example the resilient force, acts to bring the grinding body into axial engagement with the first flange part.

It is preferred in this connection if the braking means are equipped with a second ring part which is loaded by a spring to project axially beyond the flange part.

This feature provides the advantage that a particularly efficient braking effect is achieved because the second ring part is in contact with the body over its whole circumference and brakes the body by an adjustable resilient force even when the engagement between the flange parts is still sufficiently loose to enable the first ring part to be still rotated.

Other advantages of the invention will appear from the specification and the attached drawing.

It is understood that the features that have been described before and will be explained hereafter may be used not only in the described combinations, but also in any other combination, or individually, without leaving the scope and intent of the present invention.

Certain embodiments of the invention will now be described in more detail with reference to the drawing in which.

Figure 1:
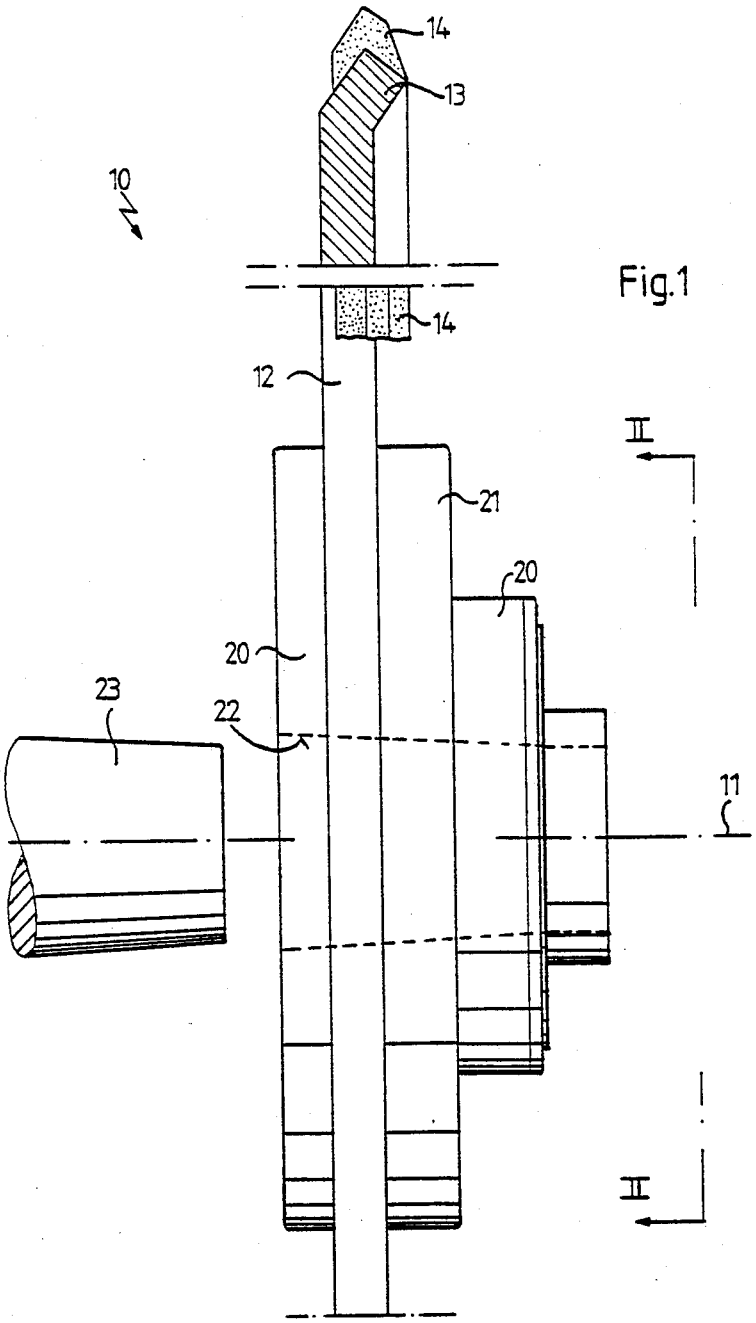
FIG. 1 shows a radial view, partly broken away and partly in cross-section, of one embodiment of a grinding wheel according to the invention.

In FIG. 1, a grinding wheel of the type used in numerically controlled grinding machines is indicated generally by reference numeral 10. The grinding wheel 10 is arranged about an axis of symmetry 11.

A disc-shaped body 12, which may for example consist of metal, is equipped at its periphery with a trimming 14 of a grinding material. The trimming 14 consists preferably of CBN (Cubic Boron Nitride).

It is understood, however, that this design is described by way of example and that disc-shaped bodies 12 of other design may also be used within the scope of the present invention. In order to retain the disc-shaped body 12 in a centered position relative to the axis 11, and to provide it with suitable mounting means, a flange arrangement is provided which embraces the disc-shaped body 12 on both sides. The flange arrangement comprises a first flange part 20 acting as main flange and a second flange part 21 acting as counterflange. The main flange is in contact with the left side of the disc-shaped body 12—as viewed in FIG. 1—and passed through a central opening in the disc-shaped body 12, which is not shown in detail in FIG. 1, and through another such central opening in the second flange part 21 acting as counterflange and supporting the flat disc-shaped body 12 on its right flat side—as viewed in FIG. 1.

The flange parts 20, 21 are screwed together by axially extending screws, as will be explained in more detail further below. The screws, therefore, hold the disc-shaped body 12 between them in force-locking engagement, it being possible to provide additional form-locking entraining means.

A central mounting opening 22 extends through the first flange part 20 in the direction of the axis 11. The mounting opening 22 has a conventional conical shape, complementary to the usual mounting arbor 23 of a grinding machine which is also indicated in FIG. 1 extremely diagrammatically.

Figure 2:
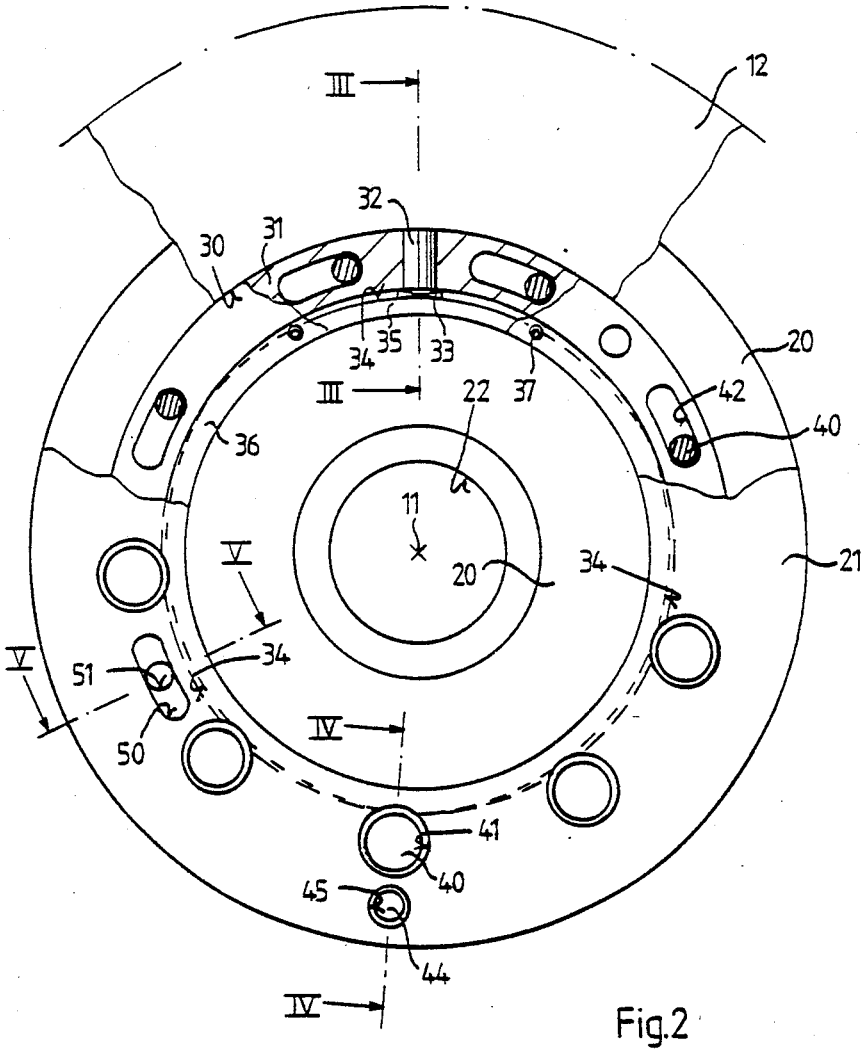
FIG. 2 shows an axial view in the direction of arrows II—II in FIG. 1, of the grinding wheel illustrated in FIG. 1, likewise partly in cross-section and partly broken away.

As can be seen best in the axial view of FIG. 2, the disc-shaped body 12 exhibits a cylindrical inner circumference 30 by which the body 12 is in contact with the first ring part 31 which in turn exhibits a torodial shape. The first ring part 31 is provided with a plurality of radial bolts 32 which are distributed over its circumference and of which only one is shown in FIG. 2, for the sake of clarity.

The radial bolts 32 project radially beyond the first ring part 31, toward the axis 11, and must have an exactly accurate length. A shoulder 33 prevents the bolts 32 from getting lost.

The first flange part 20 is provided with a circumferential surface 34 whose cross-section, taken along a radial plane, exhibits the shape of a polygon, as is clearly indicated by the broken line in FIG. 2. The shape of the circumferential surface 34 may be selected in such a manner that a triangular polygon according to DIN 32711 is obtained, for example a so-called P3G profile, which is known in the art also as "constant-diameter cam" as its diameter has the same length for all angles of the diameter relative to a reference coordinate system. If a triangular polygon is used as shape for the circumferential surface 34, then the first ring part 31 is provided with three radial bolts 23 distributed over the circumference of the first ring part 31 at spacings of 120° each. If, however, a four-cornered polygon is selected, as defined by DIN 32711, four radial bolts 32 would have to be used and distributed over the circumference of the first ring part 31 at spacings of 90° each.

Figure 3:
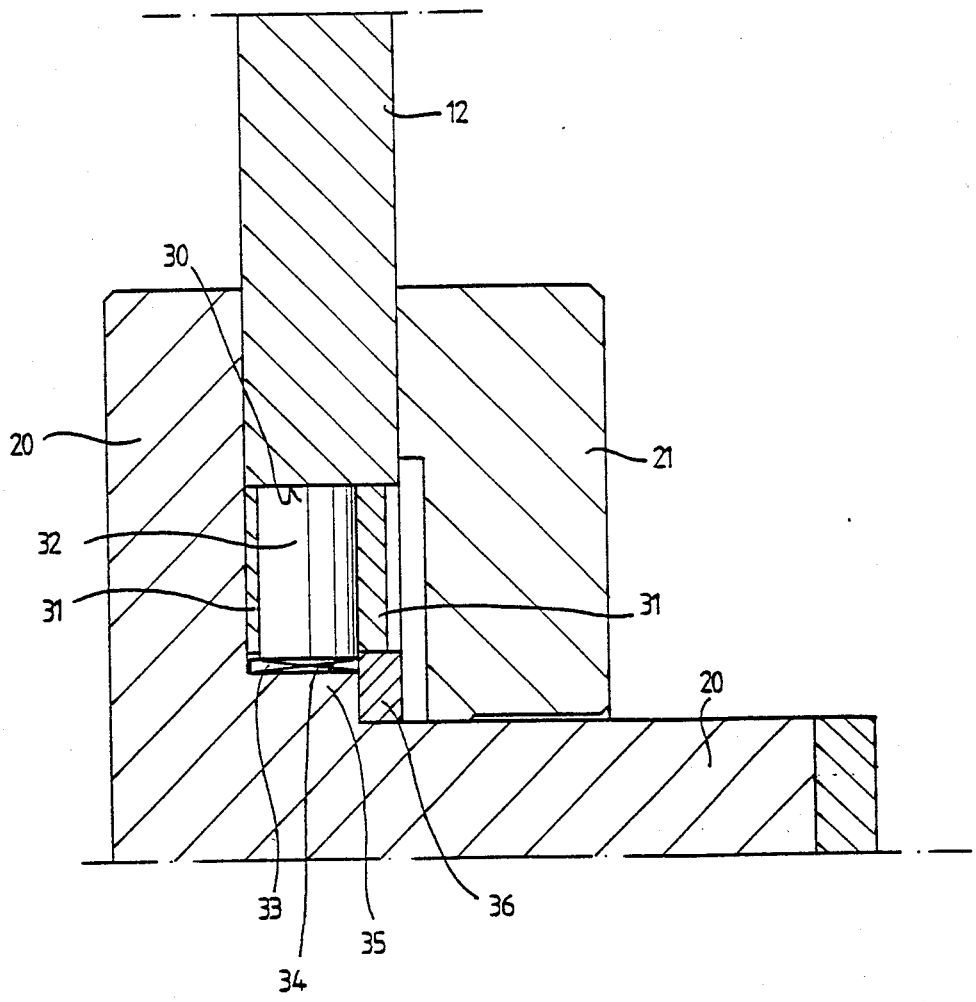
FIG. 3 shows an enlarged cross-sectional view of a detail, viewed in the direction of arrows III—III in FIG. 2.

As can be seen best in the enlarged cross-section of FIG. 3, the circumferential surface 34 is provided on a radial shoulder 35 of the first flange part 20. In the arrangement shown in FIG. 3, therefore, the first ring part 31 is supported to the left by the first flange part 20, while a separate retaining ring 36 is provided as support to the right. The retaining ring 36 is screwed to the radial shoulder 35, as indicated at 37 in FIG. 2. In order to prevent any unwanted rotation of the radial bolts 32, their shoulders 33 have a non-circular, for example cuboid, shape and are retained laterally by the first flange part 20, or the retaining ring 36 along straight contact surfaces so that any rotation of the shoulders 33 and, accordingly, of the radial bolts 32 is excluded.

It results from the above explanations that the first ring part 31 can be centered relative to the first flange part 20 in a simple manner by rotating the two parts 31, 20 relative to each other. The shoulders 33 of the radial bolts 32 then come into contact with the polygonal circumferential surface 34, and the known self-centering effect of polygon connections occurs, due to the fact that the radial bolts 32 correspond in number to the number of corners of the polygon and are distributed evenly over the circumference of the first ring part 31. Consequently, once the shoulders 33 rest against the polygonal circumferential surface 34, the axes of the first ring part 31 and of the first flange part 22 coincide with each other and also with the axis 11 of the grinding wheel 10.

Figure 4:
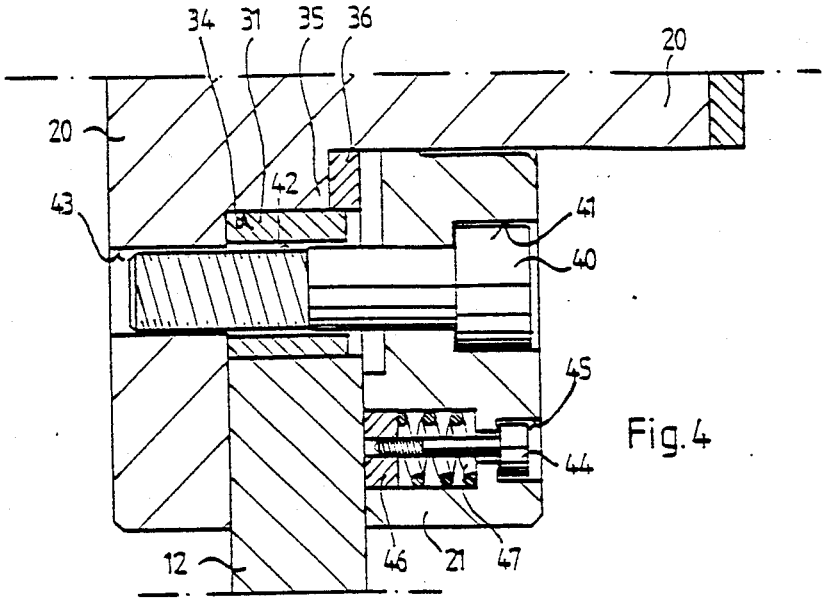
FIG. 4 shows another similar view taken in the direction of arrows IV—IV in FIG. 2.

In order to enable the first ring part 31 to be rotated relative to the first flange part 20, and the whole grinding wheel 10 to be fixed thereafter, the following means are provided:

FIG. 4, in conjunction with FIG. 2, shows a first screw 40 extending—viewed from the right in FIG. 4—from a first blind bore 41 in the flange part 21 through a first oblong hole 42 in the first ring part 31 into a threaded bore 43 in the first flange part 20.

The first screw 40 serves for clamping the flange parts 20, 21 together; the arrangement uses a plurality of such first screws 40, for example nine first screws 40, with a view to achieving a high surface pressure between the flange parts 20, 21 and the disc-shaped body 12.

As long as the first screws 40 have not been tightened, the first ring part 31 can still be turned in the circumferential direction within limits which are determined by the length of the first oblong holes 42, as appears very clearly from FIG. 2.

When during assembly of the grinding wheel 10, the first ring part 31 is rotated for the purpose of centering the body 12, the body 12 should not be entrained.

For this purpose, a second screw 44—see FIGS. 2 and 4—is arranged in a second blind bore 45 of the second flange part 21. The free end of this screw is screwed into a second ring 46 acting as a braking ring. The second ring 46 is loaded by a spring 47 in such a manner that in the unassembled condition and in the loose condition of the flange parts 20, 21 the second ring 46 projects slightly beyond the left radial surface—as viewed in FIG. 4—of the second flange part 21.

When during assembly of the grinding wheel 10 the first screws 40 are tightened slightly, this has the effect on the one hand to press the second ring 46, acting as braking ring, against the body 12 so that the latter is fixed in the axial direction and in the circumferential direction relative to the first flange part 2. The first ring part 31 can still be rotated, but the body 12—as desired—is not entrained by this movement, being fixed by the second ring 46.

In order to achieve a uniform contact between the second ring 46 and the body 12, a plurality of second screws 44 with springs 47 are distributed over the periphery of the second flange part 21, for example three such screws 44, arranged at spacings of 120° each.

Figure 5:
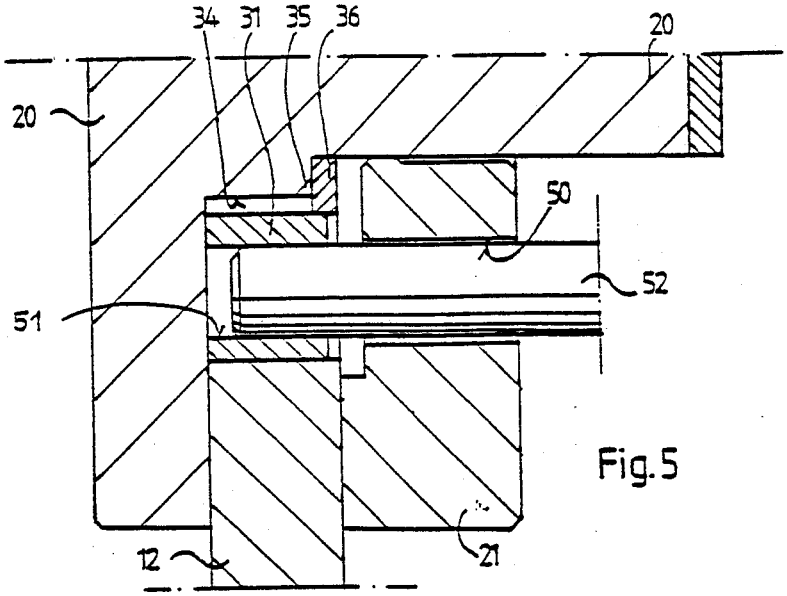
FIG. 5 shows still another similar view taken in the direction of arrows V—V in FIG. 2.

As results from the above explanations, the first ring part 31 is fully enclosed between the flange parts 20, 21. In order to provide a possibility, in spite of this fact, to rotate the ring part 31 from the outside, the invention proposes the arrangement illustrated in FIGS. 2 and 5. The second flange part 21 is provided with a second oblong hole 50 which is aligned with a bore 51 in the first ring part 31. Preferably, two such second oblong holes 50 and bores 51 are provided on the first ring part 31 in diametrically opposite arrangement relative to the axis 11.

Now, when a pin 52 engages the bore 51, through the second oblong hole 50, then the first ring part 31 can be rotated easily in its enclosed position between the two flange parts 20, 21. The tool used for this purpose may, for example, be designed in the manner of a steering wheel of a motor vehicle provided on its rear side, facing away from the user, with a bar which extends radially through the axis of the steering wheel and which is provided with two axially extending pins 52 arranged at diametrically opposite positions. The tool in the form of a steering wheel is now placed upon the loosely assembled grinding wheel 10—from the left in the view of FIG. 5—while the first screws 40 are still tightened only so far that the braking effect of the second ring part 46 becomes active. By rotating the steering wheel, with the flange parts 20, 21 held in position, the first ring part 31 is now turned in the described manner until the shoulders 33 come into contact with the circumferential surface 34. In this position, the first screws 40 are tightened firmly and the flange parts 20, 21 are firmly clamped against each other, enclosing between them the disc-like body 12.

It is understood that the above arrangement has been described only by way of example and that numerous modifications are possible as regards the type, size, dimensions and number of the different elements, in particular as regards the described screw connections and actuating means, without leaving the scope of the present invention.

So, it is in particular understood that the arrangement may of course be reversed, from the point of view cinematics, in which case the body 12 may be provided with a polygonal shape on its inner circumferential surface, while the radial projections, for example the radial bolts 32 are then provided in corresponding arrangement on the circumferential surface 34 of the first flange part 20.

It is further understood that the first screws 40 need not necessarily be passed through the first ring part 31, but may be arranged also at other radial positions of the grinding wheel 10, if only sufficient space is available.

In addition, instead of providing pins 52 and bores 51 for turning the first ring part 31, one may also use any other form-locking arrangement where axial pins, for example, connected rigidly with the first ring part 31 project outwardly beyond the second flange part 21.

Figure 6:
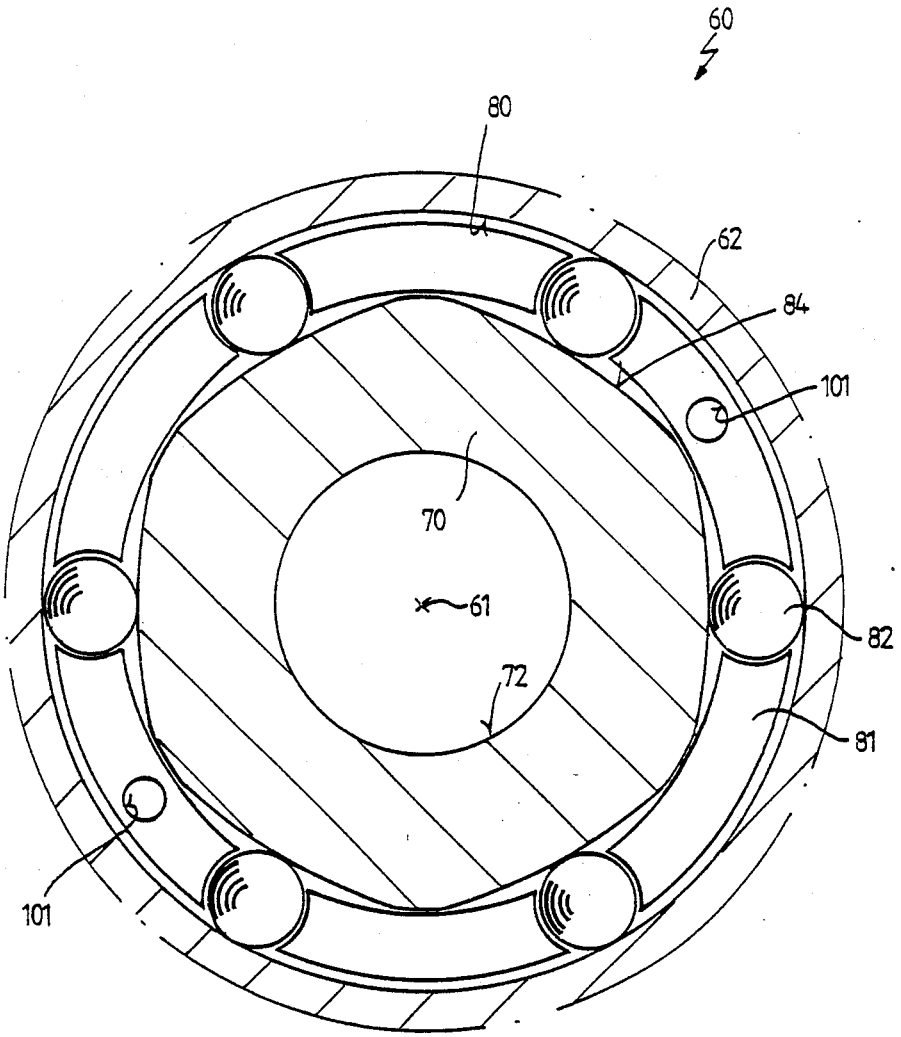
FIG. 6 is a representation similar to that of FIG. 2 showing however, another embodiment of the invention.
Figure 7:
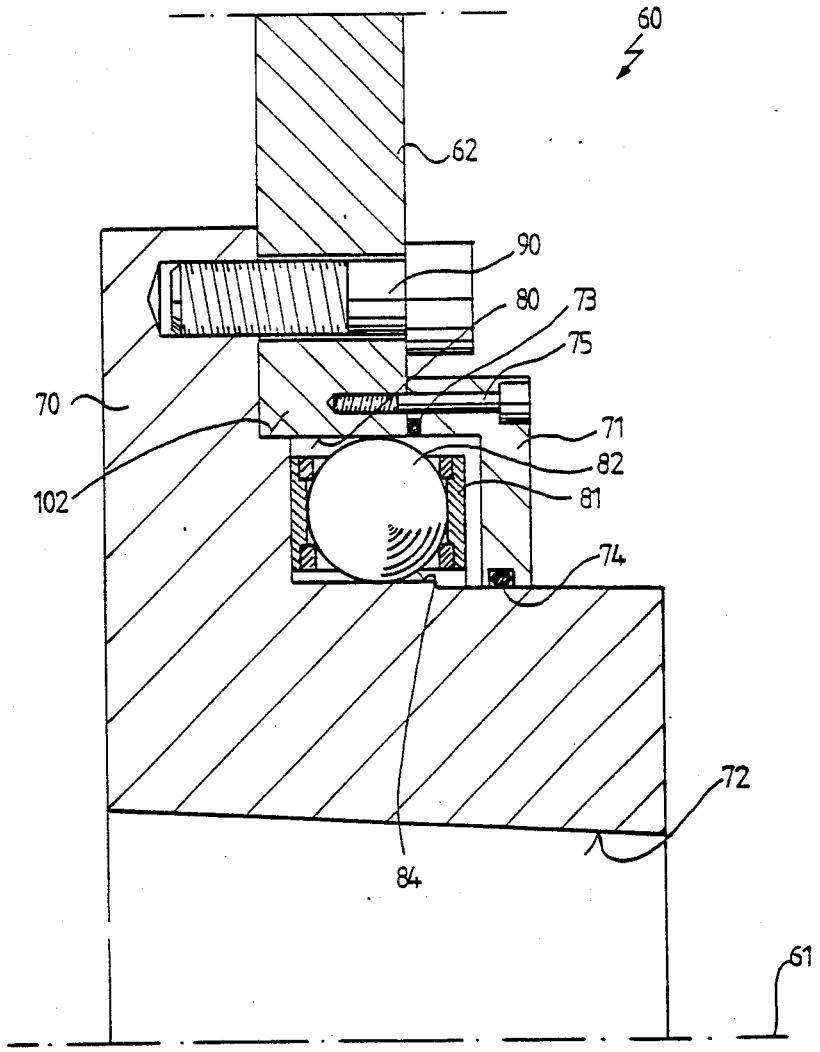
FIG. 7 is a representation similar to that of FIG. 3 showing, however, the other embodiment illustrated in FIG. 6.

FIGS. 6 and 7 illustrate another embodiment of a grinding wheel 60 according to the invention. The grinding wheel 60 corresponds to the arrangement described above with reference to FIGS. 2 and 3, as regards its arrangement about the rotary axis 61 and its disc-shaped body 62.

In the case of the embodiments of FIGS. 6 and 7, a first flange part 70 and a second flange part 71 enclosing a mounting opening 72 serve again as main flange and counter flange, respectively.

In the case of this embodiment, however, the second flange part 71 performs substantially the function of a cover protecting the centering means, which will be described in more detail below, from soiling during operation of the grinding wheel 60. The second flange part 71 is provided for this purpose with seals 73, 74 by which it bears against the disc-like body 72 or the first flange part 70. Screws 75 securing the second flange part 71 to the disc-like body 62 are illustrated in FIG. 7.

The inner circumference 80 of the disc-like body 62 is in contact with a circumferential surface 84 of the first flange part 70, via a ball bearing comprising a cage 81 and balls 82, it being understood that three balls would be sufficient, too.

As can be seen best in FIG. 6, the circumferential surface 84 of the first flange part 70 exhibits in this example a twelve-cornered contour, with six sides of a polygon having a large radius of curvature alternating in pairs with six arcs of the circle from which the sides of the polygon have been worked out. The six balls 82 rest on the sides of the polygon, which in addition extend over a larger section of the periphery. In contrast, the inner circumference 80 of the disc-shaped body 62 presents a cylindrical contour. However, it goes without saying that this arrangement may also be reversed by giving the inner circumference 80 the contour of a polygon and the circumferential surface 84 a cylindrical contour. Further, it is understood that instead of using six balls 82 or a polygon with six sides, it would also be possible to use three, or nine, balls, etc.

From FIG. 6 it appears that in the case of this embodiment of the invention the disc-shaped body 62 is screwed directly to the first flange part 70, by means of screws 90 of which six, for example, may be distributed over the periphery.

The cage 81 is provided, at two diametrically opposite positions, with bores 101 which can be seen best in FIG. 6. The bores 101 serve for introducing a tool into the cage 81 for the purpose of turning it relative to the first flange part 70 and the disc-shaped body 62.

For assembling the grinding wheel 60 one proceeds conveniently as follows:

To begin with, the first flange part 70 is placed by its left end face—as viewed in FIG. 7—upon a horizontal support so that the axis 61 extends along a vertical line. Thereafter, the disc-shaped body 62 is positioned on the first flange part 70 from above and pre-centered with the aid of a continuous shoulder 102 shown in FIG. 7. Then the screws 90 are screwed in loosely, but not tightened at this point of the work. Now, the cage 81 with the balls 82 is inserted into the annular groove left between the disc-shaped body 82 and the first flange part 70. Thereafter, the tool, which preferably has the shape of a steering wheel and which has been explained in detail above, is introduced into the bores 101 by its pins, and the cage 81 with the balls 82 is turned in the circumferential direction until the balls 82 get jammed between the cylindrical circumference 80 and the polygonal circumferential surface 84. This condition makes itself felt by a motable resistance at the tool. After the scews 90 have been tightened using a torque wrench, the operation is completed by mounting the second flange part 71 as a sealing ring.

It is understood that instead of using the ball bearing 81, 82, one may of course also use a roller bearing.

We claim:

1. A grinding wheel comprising:

a rotational disk-shaped body;

a circumferential layer of grinding material arranged on a circumferential rim of said body;

a flange for holding said body and having a central mounting opening for receiving a holding arbor of a grinding machine, said flange having a circumferential surface, said circumferential surface having a radial cross-section of a n-cornered polygon, centering elements protruding radially from said body and contacting said circumferential surface, said centering elements being circumferentially distributed over said body and being equal in number with the number of corners of said polygon;

means for rotating said circumferential surface relatively to said centering elements.

2. The grinding wheel of claim 1, wherein said flange comprises a first flange part and a second flange part holding said body on both sides thereof.

3. The grinding wheel of claim 1, wherein said body is provided with an inner cylindrical surface embracing a first ring part, said first ring part being provided with said centering elements being evenly distributed circumferentially over said first ring part and being arranged in said first ring part to project inwardly therefrom.

4. The grinding wheel of claim 3, wherein said centering elements are made as bolts with a cylindrical portion and a projecting portion protruding radially from said first ring part.

5. The grinding wheel of claim 4, wherein said projecting portion is of non-circular radial cross-section and is held laterally by flange parts.

6. The grinding wheel of claim 3, wherein said centering elements are made as balls being retained in a circumferential direction of said grinding wheel, by said first ring part, said first ring part being made as a cage, said balls being in contact in one radial direction with said circumferential surface and in an opposite radial direction with said inner cylindrical surface respectively.

7. The grinding wheel of claim 3, wherein two flange parts embrace said body on two sides thereof.

8. The grinding wheel of claim 7, wherein said flange parts are interconnected by means of first axial screws for retaining said body in a force-locking manner, said first axial screws passing through first oblong holes provided in said first ring part and extending in a circumferential direction thereof.

9. The grinding wheel of claim 3, wherein said first ring part is provided with retaining means, particularly bores, for enabling said first ring part to be rotated in a circumferential direction thereof by means of a tool.

10. The grinding wheel of claim 9, wherein said flange part is provided with second oblong holes extending in a circumferential direction and giving access to said retaining means in said first ring part.

11. The grinding wheel of claim 1, wherein said circumferential surface has a radial cross-sectional shape of a polygon, the number of corners thereof being a multiple of three.

12. The grinding wheel of claim 1, wherein said polygon is a constant-diameter cam.

13. The grinding wheel of claim 1, wherein elastic braking means are provided for acting between said flange and said body, said braking means being preferably provided on said flange.

14. The grinding wheel of claim 13, wherein said braking means are provided with a second ring part being loaded by a spring for projecting actually beyond said flange.

15. A grinding wheel comprising:

a rotational disk-shaped body, said body having a circumferential surface, said circumferential surface having a radial cross-section of a n-cornered polygon;

a circumferential layer of grinding material arranged on a circumferential rim of said body;

a flange for holding said body and having a central mounting opening for receiving a holding arbor of a grinding machine;

centering elements protruding radially from said flange and contacting said circumferential surface, said centering elements being circumferentially distributed over said flange and being equal in number with the number of corners of said polygon;

means for rotating said circumferential surface relatively to said centering elements.

* * * * *